US005943079A

United States Patent [19]

Yoshida

[11] Patent Number: 5,943,079

[45] Date of Patent: Aug. 24, 1999

[54] INK JET HEAD

[75] Inventor: Hitoshi Yoshida, Kounan, Japan

[73] Assignee: Brother Kogyo Kabushiki Kaisha, Nagoya, Japan

[21] Appl. No.: 08/751,765

[22] Filed: Nov. 8, 1996

[30] Foreign Application Priority Data

Nov. 20, 1995 [JP] Japan ..... 7-326351
Nov. 20, 1995 [JP] Japan ..... 7-326352

[51] Int. Cl.[6] ..... B41J 2/17
[52] U.S. Cl. ..... 347/94
[58] Field of Search ..... 347/94, 70, 71

[56] References Cited

U.S. PATENT DOCUMENTS 4,599,628 7/1986 Doring et al. ..... 347/71

FOREIGN PATENT DOCUMENTS

B2-3-30502 4/1991 Japan .

*Primary Examiner*—N. Le
*Assistant Examiner*—Judy Nguyen
*Attorney, Agent, or Firm*—Oliff & Berridge, PLC

[57] ABSTRACT

Disclosed is the ink jet head in which a part of the partition wall of the ink manifold 8 is constructed from the flexible damper membrane 9 which absorbs the pressure wave of the ink by being vibrated therethrough, the damper membrane 9 entirely vibrating under the single vibration mode with the same phase and having the natural frequency so as not to produce resonance with the reflected wave, thereby it can avoid that ink ejecting property is influenced by reflection occurring in the retrograde component of the pressure wave and it can obtain uniform ink ejecting property every ejecting time.

12 Claims, 3 Drawing Sheets

INK JET HEAD

BACKGROUND OF THE INVENTION

1. Field of the Invention

The present invention relates to an ink jet head which prints images by ejecting ink droplets from ink ejecting nozzles, and in particular, relates to an ink jet head having a damper membrane which absorbs retrograde pressure wave transmitted from an ink cavity to an ink manifold and both vibration mode and a natural frequency of which are prepared so that ink ejecting performance is not affected by reflection pressure wave due to the retrograde pressure wave.

And the present invention relates to an ink jet head in which printing can be uniformly conducted while avoiding that the ink ejecting performance is affected by the reflection pressure wave, by giving absorbing function of the pressure wave occurring in the ink manifold to a flexible plate which is arranged between the ink cavity and an energy element.

2. Description of Related Art

Conventionally, as shown in FIG. 5, an ink jet head is basically constructed by combining a cavity plate 71 and a piezoelectric plate 72 while arranging a vibration plate 73 therebetween, and the ink jet head is installed on a base plate 74 which acts as a mounting base. To one side of the cavity plate 71, a nozzle plate 78 in which nozzle holes 75 (in FIG. 5, one nozzle hole 75 is shown) are formed is fixed. And a cavity room 76 for supplying ink to the nozzle hole 75 from the inside is formed in the cavity plate 71.

In the above ink jet head, a plurality of the cavity rooms 76 and the nozzle holes 75 are parallel arranged so that they form a multi-channel construction. Each cavity room 76 opposes to the piezoelectric plate 72 with the vibration plate 73 therebetween and when a vibration part 72*a* in the piezoelectric plate 72 is vibrated, the cavity room 76 is selectively pressed by the vibration of the vibration part 72*a*. In the cavity plate 71, an ink manifold 77 which acts as a common ink supply path for each cavity room 76 is formed.

In case that the piezoelectric plate 72 is driven and the vibration part 72*a* is vibrated, each cavity room 76 is selectively pressed and the pressure is transmitted to the corresponding nozzle hole 75, thereby ink droplet is ejected from the nozzle hole 75 and printing of images is conducted. At that time, the pressure wave occurring due to press of the cavity room 76 includes not only advance component directing toward the nozzle hole 75 but also retrograde component directing toward the ink manifold 77.

The retrograde component of the pressure wave is reflected in the ink manifold 77 and moves toward the nozzle hole 75 behind the advance component. Here, the reflection wave due to the retrograde component is dispersed in the ink manifold 77 because the manifold 77 is used as the common ink supply path for all cavity rooms 76, thus ink is not ejected from the nozzle hole 75 by only the reflection wave. However, the reflection wave affects recovery speed of ink quantity corresponding to ink quantity which is reduced by ejecting through the advance component of the pressure wave, therefore ink ejecting quantity and ink ejecting velocity are influenced at the next ejecting time. Further, since the extent of influence depends on how many channels are driven at the same time, that is, the extent of influence changes according to the number of the channels which are simultaneously driven, ink ejecting quantity and ink ejecting velocity fluctuates every ejecting time. As a result, it concludes that printing quality goes down.

In order to dissolve the above problem, it is disclosed in Japanese Patent Application laid-open No. Hei 3-30502, a drop-on-demand type print head in which a part of wall in the ink manifold (such part of wall is shown in FIG. 5 by an arrow A) is constructed from a flexible and soft film as a pressure damper. In the print head, the retrograde component of the pressure wave is absorbed by the flexible and soft film based on that volume change occurs in the ink manifold due to vibration of the film, thus formation of the reflection wave can be avoided.

However, even if a part of the wall in the ink manifold is constructed from the flexible and soft film as in the above print head, formation of the reflection wave cannot be completely avoided. Especially, there will occur a case that the flexible film vibrates under complexed mode where node(s) is/are formed on a plane of the film according to the shape or material of the film. Under such vibration mode the above volume changing effect of the ink manifold by the film is remarkably reduced, and thus the reflection wave with a big scale which cannot be neglected will occur. Further, the reflection wave moves toward the nozzle hole through the cavity room from the ink manifold, thereafter returns to the ink manifold after reflected again by the nozzle hole. Therefore, there will occur a case that resonance is produced according to the natural frequency of the film, as a result, damping of the reflection wave is remarkably delayed.

In the above cases, the reflection wave with a big scale which is not neglectable influences the ink supply property to the ink cavity from the ink manifold. Thus, ink ejecting quantity and ink ejecting velocity fluctuates based on how many channels are driven at the same time and it concludes that printing quality goes down.

SUMMARY OF THE INVENTION

Accordingly, it is an object of the present invention to overcome the above mentioned problems and to provide an ink jet head having a damper membrane which has a vibration property that the damper membrane does not vibrate under complexed mode and has a natural frequency so that resonance of the reflection wave does not occur, thereby it can avoid that the reflection wave influences property of ink supply to an ink cavity and printing quality goes down.

And it is another object of the present invention to provide an ink jet head having a flexible plate which transmits pressure to an ink cavity from an energy element, the flexible plate also absorbing the pressure wave, thereby the number of parts constructing the ink jet head can be reduced, and further an ink jet head in which the flexible plate for absorbing the pressure wave is arranged inner side thereof, thereby construction strength thereof can be retained.

In order to accomplish the above objects, the present invention provides an ink jet head including a cavity room in which ink is supplied, an ink ejecting nozzle formed at one end of the cavity room, an ink manifold communicated with the cavity room at the other end thereof and supplying the ink thereto and an energy producing part opposing to the cavity room, the energy producing part pressing the cavity room, thereby the ink is ejected from the ink ejecting nozzle, the ink jet head further comprising:

a damper membrane which constructs a part of a partition wall in the ink manifold, entire plane of the damper membrane corresponding to the ink manifold vibrating under vibration mode that the damper membrane vibrates with the same phase and the damper membrane having a natural frequency so that the damper membrane does not resonate with pressure wave which moves toward the ink ejecting nozzle after reflected in the ink manifold and returns to the ink manifold after reflected by the ink ejecting nozzle.

In the above ink jet head, when the energy producing part is energized, the cavity room filled up with the ink is pressed by the energy producing part and pressure wave occurs in the ink. The pressure wave has advance component and retrograde component. The advance component of the pressure wave is transmitted from the cavity room to the ink ejecting nozzle, thereby the ink is ejected from the ink ejecting nozzle and printing is conducted. And the retrograde component of the pressure wave is transmitted from the cavity room to the ink manifold, thereby the damper membrane is deformed and vibrated.

At that time, the damper membrane vibrates under vibration mode that entire plane of the damper membrane corresponding to the ink manifold vibrates with the same phase, therefore volume change of the ink manifold is effectively conducted and the retrograde component of the pressure wave is efficiently absorbed. Further, the damper membrane has the natural frequency that the damper membrane does not resonate with the pressure wave which moves toward the ink ejecting nozzle after reflected in the ink manifold and returns to the ink manifold after reflected by the ink ejecting nozzle. Therefore, the reflected wave is rapidly damped and it can avoid that ink supply property to the cavity room from the ink manifold is influenced.

As mentioned above, according to the ink jet head of the present invention, it is prevented that the damper membrane vibrates under complexed vibration mode, and further the damper membrane has the natural frequency so that the damper membrane does not resonate with the reflected wave. Therefore, the ink supply property to the cavity room from the ink manifold is not influenced by the reflected wave and printing can be conducted with good quality.

Further, the present invention provides an ink jet head including a cavity room in which ink is supplied, an ink ejecting nozzle formed at one end of the cavity room, an ink manifold communicated with the cavity room at the other end thereof and supplying the ink thereto and a cover plate having an energy producing part opposing to the cavity room, the energy producing part pressing the cavity room, thereby the ink is ejected from the ink ejecting nozzle, the ink jet head further comprising:

a damper room formed in the cover plate at a position facing to the ink manifold; and a flexible plate which is arranged between the energy producing part and the cavity room and partitions both the ink manifold and the damper room;

wherein a part of the flexible plate partitioning both the ink manifold and the damper room is deformable toward both sides of the ink manifold and the damper room.

In the above ink jet head, when the energy producing part formed in the cover plate is energized, the cavity room filled up with the ink is pressed by the energy producing part and pressure wave occurs in the ink. The pressure wave has advance component and retrograde component. The advance component of the pressure wave is transmitted from the cavity room to the ink ejecting nozzle, thereby the ink is ejected from the ink ejecting nozzle and printing is conducted. And the retrograde component of the pressure wave is transmitted from the cavity room to the ink manifold, thereby the part of the flexible plate partitioning both the ink manifold and the damper room is deformed and vibrated toward both sides thereof. Based on the vibration of the part of the flexible plate, the retrograde component of the pressure wave is damped and absorbed, thus the reflected wave does not occur. Here, the part of the flexible plate partitioning both the ink manifold and the damper room is covered by the cover plate, therefore such part does not construct an outer portion of the ink jet head.

According to the above ink jet head, the flexible plate not only transmits the pressure produced by the energy producing part to the cavity room, but also absorbs the pressure wave. Therefore, number of parts necessary for the ink jet head can be reduced. And since the flexible plate is arranged in the ink jet head, it can provide the ink jet head with enough strength.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

Figure 1:
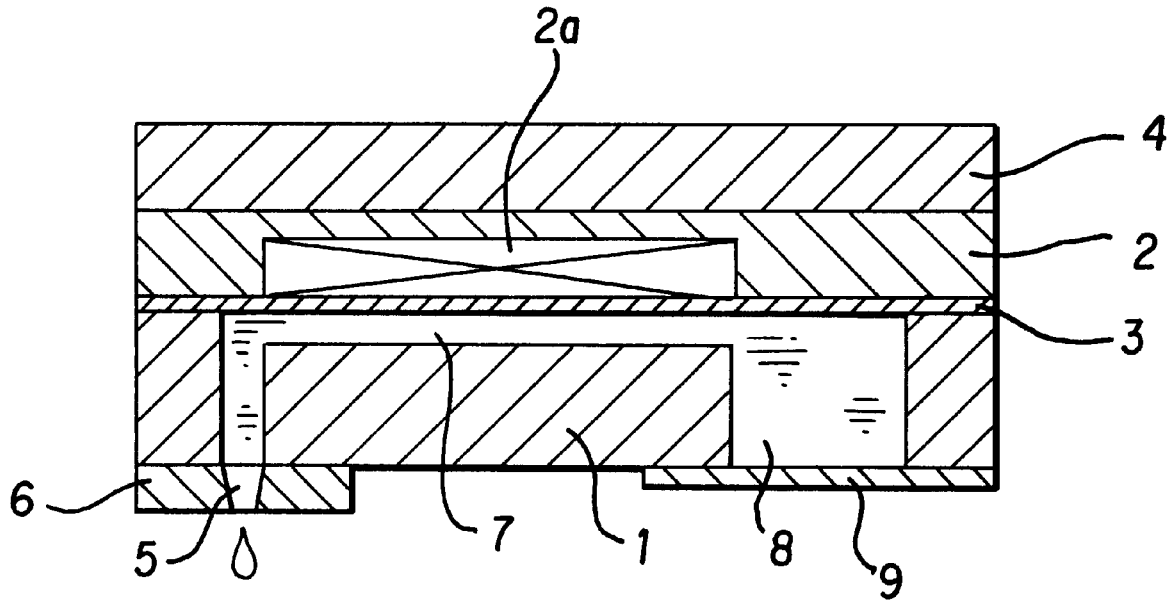
FIG. 1 is a sectional view of an ink jet head according to the first embodiment embodying the present invention.

A detailed description of an ink jet head according to the first preferred embodiment will now be given referring to the accompanying drawings. In FIG. 1, the ink jet head is basically constructed by combining a cavity plate 1 and a piezoelectric plate 2 between which a flexible vibration plate 3 is arranged and by installing them on a base plate 4. To one end of the cavity plate 1, a nozzle plate 6 in which nozzle holes 5 (in FIG. 1, one nozzle hole 5 is shown) are formed is fixed. And a cavity room 7 which supplies the ink to the nozzle hole 5 from the inside is formed in the cavity plate 1.

In the above ink jet head, a plurality of the cavity rooms 7 and the nozzle holes 5 are parallel arranged so that they form a multi-channel construction in a direction normal to thickness of drawing paper. Each cavity room 7 opposes to the piezoelectric plate 2 with the vibration plate 3 therebetween and when a vibration part 2*a* in the vibration plate 2 is vibrated, the cavity room 7 is selectively pressed by the vibration of the vibration part 2*a*, thereby the pressure wave occurs in the ink of the cavity room 7. In the cavity plate 1, an ink manifold 8 which acts as a common ink supply path for each cavity room 7 is formed. The ink manifold 8 is formed so that it penetrates the cavity plate 1 in a direction normal to thickness of drawing paper. The side thereof facing to the piezoelectric plate 2 (the upper side in FIG. 1) is closed by the vibration plate 3 and the opposite side thereof is closed by a damper membrane 9 which has flexibility similarly to the vibration plate 3.

The piezoelectric plate 2 is composed of material having piezoelectric effect such as PZT and the like and the vibration part 2*a* is formed in the plate 2 at a position corresponding to each cavity room 7 and separated thereform by the vibration plate 3. Here, a plurality of vibration parts 2*a* are parallel arranged so that they form a multi-channel construction in the direction normal to thickness of drawing paper, thereby each vibration part 2*a* corresponds to each cavity room 7 with one to one relation. The vibration part 2*a* is selectively driven according to print signal, thereby each cavity room 7 can be selectively pressed by the vibration part 2*a*.

The damper membrane 9 in the above ink jet head deforms when pressure change occurs in the ink in the ink manifold 8 and vibrates based on the elastic property thereof. At that time, it is given to the damper membrane 9 a vibration property that vibration mode becomes single mode under which all part of the damper membrane 9 facing to the ink manifold 8 vibrates with the same phase. This vibration property of the damper membrane 9 is determined based on material, thickness, ratio of length and width and similar factors thereof.

Figure 2:
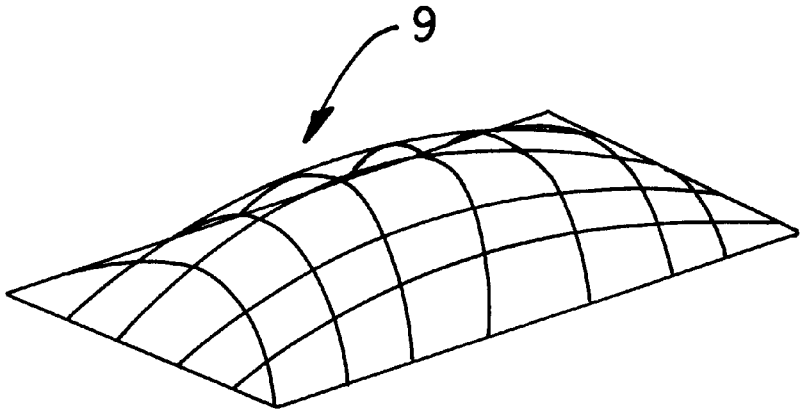
FIG. 2 is a schematic view for explaining single mode vibration of the damper membrane in the first embodiment.

One example of vibration state of the damper membrane 9 under the single mode is indicated in FIG. 2. And in order to effectively damp and dissipate the pressure wave of the ink, the natural frequency under the above vibration mode lies in a range defined by the following equation.

$$\frac{0.2}{2AL} < fr < \frac{1.5}{2AL} \tag{1}$$

In the above equation (1), fr represents the natural frequency of the damper membrane 9 and AL represents the time interval between which the pressure wave is transmitted from the ink manifold to the ejecting nozzle in the cavity room 7 filled up with the ink.

According to the equation (1), it is necessitated that the product obtained by multiplying the natural frequency fr and the time 2AL lies within a range of 0.2~1.5. It is preferable that the above product lies within a range of 0.6~1.2, and more preferably within a range of 0.8~1.1. Perfect value of the product is 1. Here, the reason why 2AL is used in the equation (1) is based on that it is considered the time necessary for the pressure wave to conduct reciprocal movement during which the pressure wave moves to the nozzle hole 5 from the ink manifold 8 after reflected in the ink manifold 8 and returns to the ink manifold 8 from the nozzle hole 5 after reflected by the nozzle hole 5. The time AL is determined based on both the distance between the ink manifold 8 and the nozzle hole 5 in the cavity plate 1 and the sonic velocity in the ink (the sonic velocity is about 900 m/s in a normal case).

In case that the product of the natural frequency fr and the time AL is equal to 1, though the pressure wave which is reflected by the nozzle hole 5 and returns to the ink manifold 8 is completely synchronized with the natural frequency of the damper membrane 9, the phase is reversed because the nozzle hole 5 acts as a free end. Therefore, the pressure wave is dissipated by mutual cancelling and negation. And if the product value lies in the range near 1, the pressure wave is rapidly damped and eventually dissipated. On the contrary, when the product value lies out of a range of 0.2~1.5, the pressure wave cannot be sufficiently cancelled and thus is remained. Therefore, according to a case, it is occurable the stationary wave. Here, though ideal value of the above product is 1, such value generally becomes about 0.9 in the concrete construction of the ink jet head.

In the above mentioned ink jet head, the ink is supplied in each cavity room 7 from the ink manifold 8 and the print signal is input to the piezoelectric plate 2, thereby the vibration part 2*a* is vibrated and the pressure wave occurs in the cavity room 7 since the cavity room 7 corresponding to the vibration part 2*a* is pressed through the vibration plate 3 by the vibration part 2*a*. The pressure wave has both the advance component which is transmitted from the cavity room 7 to the nozzle hole 5 and the retrograde component which is reversely transmitted to the ink manifold 8.

When the pressure wave of the advance component reaches to the nozzle hole 5 from the cavity room 7, the ink droplet is ejected from the nozzle hole 5. Thereby, printing is conducted by forming dot on the print sheet through the ink droplet. At that time, though ink quantity in the cavity room 7 is reduced based on ejecting of the ink droplet, the ink is supplied to the cavity room 7 from the ink manifold 8, thereby the ink droplet can be satisfactorily ejected at the next ejecting time.

On the other hand, when the pressure wave of the retrograde component reaches to the ink manifold 8 from the cavity room 7, the damper membrane 9 is deformed and vibrated by the pressure wave. According to such vibration of the damper membrane 9, volume of the ink manifold 8 is periodically changed, thereby the pressure wave is absorbed. Here, this vibration of the damper membrane 9 is single mode vibration that the part entirely facing to the plane of the ink manifold 8 is vibrated with the same phase, thus node(s) does/do not occur on the damper membrane 9 under such single mode vibration. Therefore, volume change of the ink manifold 8 can be enlarged and the vibration of the damper membrane 9 can be efficiently absorbed in comparison with a case that the damper membrane 9 is vibrated under the other complexed vibration mode.

Here, the pressure wave is not completely absorbed by only single mode vibration of the damper membrane 9. And the pressure wave of the retrograde component is reflected in the ink manifold 8 and moves toward the nozzle hole 5 through the cavity room 7 in each channel, and further the pressure wave is reflected again by the nozzle hole 5 and returns to the ink manifold 8. However, in the first embodiment, since the natural frequency of the damper membrane 9 lies in the above mentioned range, the pressure wave returning to the ink manifold 8 effectively dissipates by mutually cancelling with the vibration of the damper membrane 9. Thus, the pressure wave of the ink can be rapidly dissipated and it can avoid that the pressure wave affects on ink supply operation to the cavity room 7 from the ink manifold 8. Therefore, ink supply state in the cavity room 7 is constantly retained in the same state in spite of the number of channel which is simultaneously used for ejecting the ink droplet from the nozzle hole 5 at the previous ejecting time, as a result, printing can be done with the same ink quantity and the same ejecting velocity every ejecting time and it can maintain good printing quality.

Figure 3:
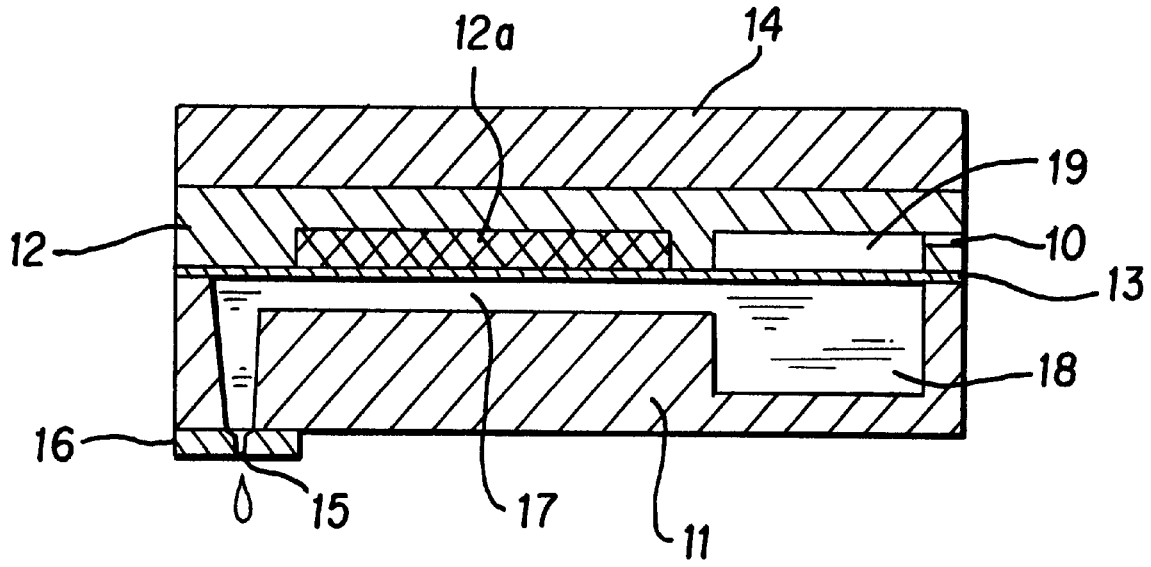
FIG. 3 is a sectional view of an ink jet head according to the second embodiment embodying the present invention.
Figure 4:
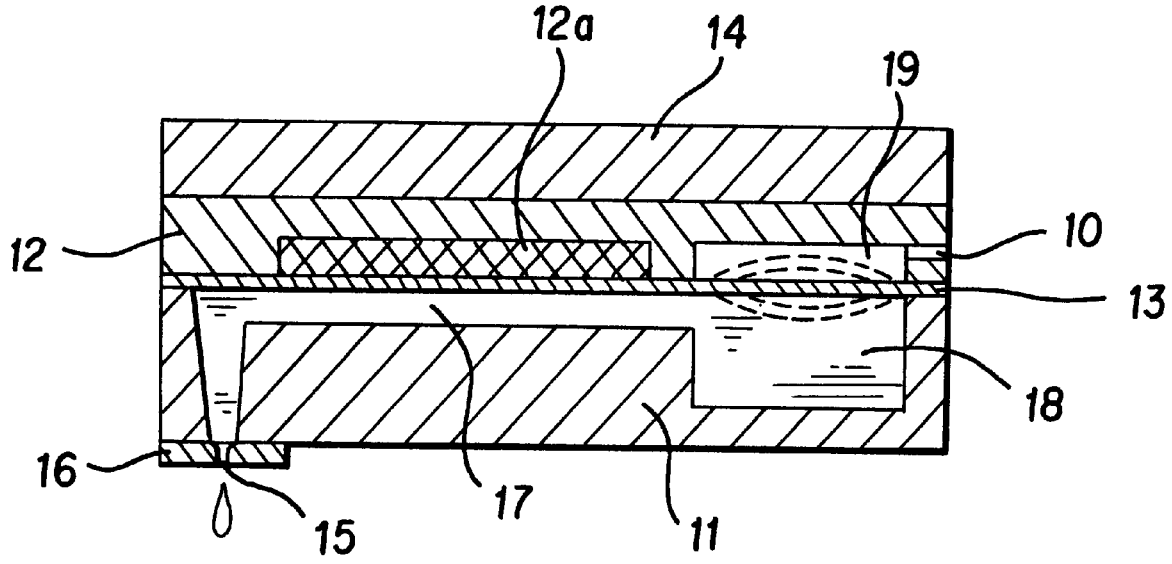
FIG. 4 is a sectional view of the ink jet head shown in FIG. 3 for explaining deformation state of a vibration plate.
Figure 5:
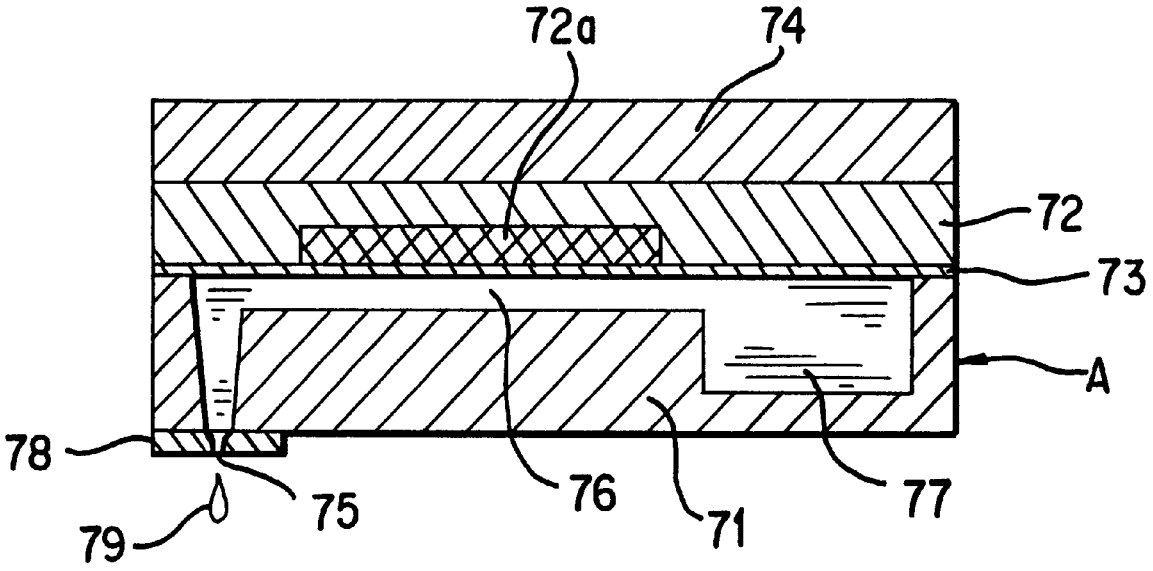
FIG. 5 PRIOR ART
FIG. 5 is a sectional view of a conventional ink jet head.

Next, the ink jet head according to the second embodiment will be described with reference to FIGS. 3 and 4. The ink jet head basically has the similar construction to the ink jet head of the first embodiment. That is, as shown in FIG. 3, the ink jet head basically is constructed by combining a cavity plate 11 and a piezoelectric plate 12 between which a flexible vibration plate 13 is arranged and by installing them on a base plate 14. To one end of the cavity plate 11, a nozzle plate 16 in which nozzle holes 15 (in FIG. 3, one nozzle hole 15 is shown) are formed is fixed. And a cavity room 17 which supplies the ink to the nozzle hole 15 from the inside is formed in the cavity plate 11.

In the above ink jet head, a plurality of the cavity rooms 17 and the nozzle holes 15 are parallel arranged so that they form a multi-channel construction in a direction normal to thickness of drawing paper. Each cavity room 17 opposes to the piezoelectric plate 12 with the vibration plate 13 therebetween and when a vibration part 12*a* in the vibration plate 12 is vibrated, the cavity room 17 is selectively pressed by the vibration of the vibration part 12*a*, thereby the pressure wave occurs in the ink of the cavity room 17. In the cavity plate 11, an ink manifold 18 which acts as a common ink supply path for each cavity room 17 is formed. The ink manifold 18 is formed so that it penetrates the cavity plate 11 in a direction normal to thickness of drawing paper.

The piezoelectric plate 12 is composed of material having piezoelectric effect such as PZT and the like and the vibration part 12*a* is formed in the plate 12 at a position corresponding to each cavity room 17 through the vibration plate 13. Here, a plurality of vibration parts 12*a* are parallel arranged so that they form a multi-channel construction in the direction normal to thickness of drawing paper, thereby each vibration part 12*a* corresponds to each cavity room 17 with one to one relation. The vibration part 12*a* is selectively driven according to print signal, thereby each cavity room 17 can be selectively pressed by the vibration part 12*a*.

Here, the ink jet head of the second embodiment is different from the ink jet head of the first embodiment at a point that the damper membrane is not arranged and the cavity plate 11 (bottom portion thereof) acts itself as a partition of the ink manifold 18. Instead, a damper room 19 is formed in the piezoelectric plate 12 at a position facing to the ink manifold 18 through the vibration plate 13. The vibration plate 13 separates the ink manifold 18 and the damper room 19. And the damper room 19 is formed entirely over the ink manifold 18. Thus, the portion of the vibration plate 13 facing to both the ink manifold 18 and the damper room 19 (such portion separates the ink manifold 18 and the damper room 19) will be deformable toward both sides of the ink manifold 18 and the damper room 19, as shown in FIG. 4, and the above portion of the vibration plate 13 can vibrate corresponding to the pressure wave. And a through hole 10 which acts for communicating the damper room 19 with atmosphere.

As understandable from the above, in the ink jet head of the second embodiment, the damper room 19 is formed in the piezoelectric plate 12 and the portion of the vibration plate 13 facing to both the ink manifold 18 and the damper room 19 has the same function as the damper membrane in the first embodiment. Therefore, number of parts necessary for the ink jet head can be reduced. Here, the vibration mode and the natural frequency of the above portion of the vibration plate 13 is as same as those of the damper membrane 9 in the first embodiment.

In the above constructed ink jet head, the ink is supplied in each cavity room 17 from the ink manifold 18 and the print signal is input to the piezoelectric plate 12, thereby the vibration part 12*a* is vibrated and the pressure wave occurs in the cavity room 17 since the cavity room 17 corresponding to the vibration part 12*a* is pressed through the vibration plate 13 by the vibration part 12*a*. The pressure wave has both the advance component which is transmitted from the cavity room 17 to the nozzle hole 15 and the retrograde component which is reversely transmitted to the ink manifold 18.

When the pressure wave of the advance component reaches to the nozzle hole 15 from the cavity room 17, the ink droplet is ejected from the nozzle hole 15. Thereby, printing is conducted by forming dot on the print sheet through the ink droplet. At that time, though ink quantity in the cavity room 17 is reduced based on ejecting of the ink droplet, the ink is supplied to the cavity room 17 from the ink manifold 18, thereby the ink droplet can be satisfactorily ejected at the next ejecting time. Here, transmitting velocity of the pressure wave in the ink in the cavity room 17, that is, the sonic velocity is about 900 m/s.

On the other hand, when the pressure wave of the retrograde component reaches to the ink manifold 18 from the cavity room 17, the portion of the vibration plate 13 separating both the ink manifold 18 and the damper room 19 is deformed and vibrated by the pressure wave. At this time, such portion of the vibration plate 13 vibrates toward both sides of the ink manifold 18 and the damper room 19 as shown in FIG. 4 and the pressure wave of the retrograde component is absorbed and damped. Here, since the vibration of the vibration plate 13 is done under the single vibration mode as in the first embodiment and the natural frequency of the vibration plate 13 lies in a range defined by the equation (1), the pressure wave can be efficiently absorbed.

Further, since the damper room 19 is communicated with atmosphere through the through hole 10, the pressure wave is scarcely changed even if the volume of the ink manifold 18 is changed by vibration of the vibration plate 13. Thus, damping of the pressure wave is promoted. Accordingly, since the pressure wave of the retrograde component is rapidly damped in the ink manifold 18, reflection wave toward the nozzle hole 15 through the ink manifold 18, the cavity room 17 does not occur.

Therefore, ink supply from the ink manifold 18 to the cavity room 17 where the ink droplet is ejected by the pressure wave of the advance component is conducted without being influenced by the reflection wave. As a result, printing can be done with the same ink quantity and the same ejecting velocity every ejecting time and it can maintain good printing quality.

As mentioned in detail, according to the ink jet head of the first embodiment, since the part of the partition wall of the ink manifold 8 is constructed from the damper membrane 9 which vibrates under the single mode and has the predetermined natural frequency defined by the equation (1), the pressure wave of the ink can be efficiently absorbed and rapidly dissipated. Thus, ink supply in the cavity room 7 is conducted without being affected by the reflection wave of the pressure wave, thereby printing can be done with the same ink quantity and the same ejecting velocity every ejecting time and it can maintain good printing quality.

According to the ink jet head of the second embodiment, since the damper room 19 is formed in the piezoelectric plate 12 and the vibration plate 13 is made deformable so that the vibration plate 13 deforms toward both sides of the ink manifold 18 and the damper room 19, the pressure wave of the retrograde component occurring in the cavity room 17 by driving the vibration part 12*a* of the piezoelectric plate 12 is damped based on the vibration of the part of the vibration plate 13 facing to both the ink manifold 18 and the damper room 19, thus the reflection wave does not occur. Therefore, ink supply from the ink manifold 18 to the cavity room 17 where the ink droplet is ejected by the pressure wave of the advance component is uniformly conducted without being influenced by the reflection wave, thereby the predetermined ink quantity corresponding to the reduced ink used for ink ejection can be supplied to the cavity room 17 from the ink manifold 18. As a result, the ink droplet can be ejected with the same ink ejecting quantity and the same ink ejecting velocity every time without being affected by the number of channels simultaneously driven and the ejecting interval. Accordingly, printing can be done with the same ink quantity and the same ejecting velocity every ejecting time and it can maintain good printing quality.

In particular, similar to the first embodiment, since the vibration of the vibration plate 13 is done under the single vibration mode as in the first embodiment and the natural frequency of the vibration plate 13 lies in a range defined by the equation (1), the pressure wave can be efficiently absorbed.

Further, since the through hole 10 is formed in the damper room 19 and thereby the damper room 19 is communicated with atmosphere through the through hole 10, the pressure wave is scarcely changed even if the volume of the ink manifold 18 is changed by vibration of the vibration plate 13. Thus, damping of the pressure wave is promoted. Accordingly, since the pressure wave of the retrograde component is rapidly damped in the ink manifold 18, reflection wave toward the nozzle hole 15 through the ink manifold 18, the cavity room 17 does not occur.

And since the damper room 19 is formed entirely over the ink manifold 18, the pressure wave occurring by vibration of the vibration plate 3 can be effectively absorbed. Further, the damper room 19 is formed between the piezoelectric plate 12 and the vibration plate 13, and both the ink manifold 18 and damper room 19 are partitioned by a part of the vibration plate 13, thereby the vibration plate 13 is arranged in the ink jet head without forming outer portion thereof. Thus, strength of the ink jet head can be improved.

Here, as the vibration plate 13, the member which is conventionally used for transmitting the vibration of the vibration part 12*a* in the piezoelectric plate 12 to the cavity room 17, is applied, therefore the number of parts necessary for the ink jet head can be reduced.

While the invention has been particularly shown and described with reference to preferred embodiments thereof, it will be understood by those skilled in the art that the foregoing and other changes in form and details can be made therein without departing from the spirit and scope of the invention.

For example, in the above embodiments, though the piezoelectric plate 2, 12 are entirely composed of material having piezoelectric effect such as PZT, it is enough that at least the vibration part 2*a*, 12*a* is composed of such material. Thus, in the second embodiment, it is conceivable that the portion surrounding the damper room 19 may be formed from ceramics, metal or resin.

What is claimed is:

1. An ink jet head comprising:

a cavity room in which ink is supplied, the cavity room having a wall;

an ink ejecting nozzle formed at one end of the cavity room;

an ink manifold communicated with the cavity room at an opposite end to the one end of the cavity room and supplying the ink to the cavity room;

a cover plate having an energy producing part opposing to the cavity room and on the wall of the cavity room, the energy producing part pressing the cavity room, thereby the ink is ejected from the ink ejecting nozzle; and a damper room formed in the cover plate at a position facing to the ink manifold;

wherein the wall of the cavity room is a flexible plate which is arranged between the energy producing part and the cavity room and partitions both the ink manifold and the damper room;

wherein a part of the flexible plate partitioning both the ink manifold and the damper room is deformable toward both sides of the ink manifold and the damper room.

2. The ink jet head according to claim 1, wherein the cover plate is composed of piezoelectric material.

3. The ink jet head according to claim 1, wherein a through hole is formed in a wall forming a part of the damper room so as to communicate the damper room with atmosphere.

4. The ink jet head according to claim 3, wherein the damper room is formed entirely over the ink manifold.

5. The ink jet head according to claim 4, wherein a pressure wave is produced in the cavity room when the energy producing part is energized, the pressure wave having an advance component and a retrograde component, the advance component being transmitted from the cavity room to the ink ejecting nozzle and the retrograde component being reversely transmitted from the cavity room to the ink manifold.

6. The ink jet head according to claim 5, wherein the advance component acts so as to eject the ink from the ink ejecting nozzle, and the retrograde component vibrates the part of the flexible plate existing between the damper room and the ink manifold and is absorbed thereby.

7. The ink jet head according to claim 5, wherein the part of the flexible plate vibrates in a vibration mode such that the part of the flexible plate vibrates with a phase which is entirely the same over the part of the flexible plate and has a natural frequency so that the part of the flexible plate does not resonate with the retrograde component of the pressure wave remaining in the ink manifold after the ink is ejected from the ink ejecting nozzle.

8. The ink jet head according to claim 7, wherein the vibration mode is single vibration mode without node occurrence on the part of the flexible plate.

9. The ink jet head according to claim 7, wherein the natural frequency of the part of the flexible plate lies in a range defined by a following equation:

$$\frac{0.2}{2AL} < fr < \frac{1.5}{2AL}$$

in the equation, fr represents the natural frequency of the part of the flexible plate and AL represents a time interval during which the advance component of the pressure wave is transmitted from the ink manifold to the ink ejecting nozzle when the ink is ejected from the ink ejecting nozzle.

10. The ink jet head according to claim 9, wherein product obtained by multiplying the natural frequency fr and 2AL lies in a range of 0.6~1.2 according to the equation.

11. The ink jet head according to claim 10, wherein the product obtained by multiplying the natural frequency fr and 2AL lies in a range of 0.8~1.1 according to the equation.

12. The ink jet head according to claim 11, wherein the product obtained by multiplying the natural frequency fr and 2AL is approximately 0.9.

* * * * *